US006000077A

United States Patent [19]

Cyr

[11] Patent Number: 6,000,077

[45] Date of Patent: Dec. 14, 1999

[54] SINGLE MOTOR FULLY ADJUSTABLE BED

[76] Inventor: David R. Cyr, 281 Monterey Blvd., San Francisco, Calif. 94131

[21] Appl. No.: 09/114,375

[22] Filed: Jul. 14, 1998

[51] Int. Cl.[6] ..... A61G 7/015; A61G 7/018; A61G 7/012

[52] U.S. Cl. ..... 5/618; 5/616; 74/665 F; 74/89.17; 192/48.2

[58] Field of Search ..... 5/618, 613, 616, 5/617, 611, 600; 74/665 F, 89.17; 192/48.2

[56] References Cited

U.S. PATENT DOCUMENTS

| | | | |
|---|---|---|---|
| 4,324,010 | 4/1982 | Houlberg et al. . | |
| 4,425,674 | 1/1984 | Werner . | |
| 4,472,846 | 9/1984 | Volk, Jr. et al. . | |
| 4,559,655 | 12/1985 | Peck . | |
| 4,860,394 | 8/1989 | Benessis et al. . | |
| 4,935,974 | 6/1990 | Stebbins et al. . | |
| 4,959,957 | 10/1990 | Schmall et al. . | |
| 4,970,737 | 11/1990 | Sagel . | |
| 5,063,624 | 11/1991 | Smith et al. . | |
| 5,129,116 | 7/1992 | Borders et al. | 5/600 |
| 5,136,742 | 8/1992 | Stebbins et al. | 5/618 |
| 5,161,274 | 11/1992 | Hayes et al. | 5/618 |
| 5,195,198 | 3/1993 | Travis | 5/618 |
| 5,317,769 | 6/1994 | Weismiller et al. | 5/611 |
| 5,343,581 | 9/1994 | Bartley et al. | 5/611 |
| 5,444,880 | 8/1995 | Weismiller et al. | 5/613 |
| 5,542,138 | 8/1996 | Williams et al. | 5/600 |
| 5,608,929 | 3/1997 | Crane | 5/81.1 R |
| 5,613,255 | 3/1997 | Bish et al | 5/611 |

OTHER PUBLICATIONS

Sun Tec Q Series Quick Change Beds Product Information, 1 page, (undated).

Sun Tec Parts List For Quick Change Moddels SQ3, SQ2, 2Q –Feb. 1995.

Guardian Electrics Manuf. Co. Catalog pp. 22–27, 94, 193 212–215, undated.

Invacare Corp. Catalog (12 pages), 1997.

*Primary Examiner*—Alexander Grosz

*Attorney, Agent, or Firm*—Ray K. Shahani, Esq.

[57] ABSTRACT

A drive unit for adjustable beds of the type which have movable head and leg sections, and adjustable height, comprises a unidirectional, rotary motor, and a drive shaft for each adjustable bed function. The driveshafts are selectively rotated in opposite directions by the motor. A pair of solenoids operably couple the motor with the driveshafts, interchangeably, or alternatively with a linear tracking gear, and thereby adjust the configuration of the bed.

7 Claims, 13 Drawing Sheets

SINGLE MOTOR FULLY ADJUSTABLE BED

FIELD OF THE INVENTION

This present invention relates to motorized, fully adjustable beds, and more particularly to a single motor drive assembly which operates three modes of adjustment, the head and the foot of the bed as the height of the bed, from a remote control unit.

BACKGROUND OF THE INVENTION

A drive unit for adjustable beds, such as hospital beds and the like, of the type which have movable head and leg sections, and/or other adjustment functions, and comprises a unidirectional, rotary motor, and a drive shaft for each adjustable bed function. Gears are rotatably mounted on each of the drive shafts, and are rotated thereon in opposite directions by the motor. A pair of spring clutches are operably associated with their associated shafts to rotate the shafts, and thereby adjust the position and/or configuration of the bed.

For many years, hospital beds have had movable parts, such as an upper body support part movable between two positions in which it supports the patient in a sitting position and a prone position. Movement of these parts originally was effected manually by hospital personnel, for example by turning a crank provided on the bed.

Motorized operated hospital beds are conventional in which the head and leg sections of an articulated frame can be adjusted to a desired inclination by one or more motors. In this fashion, a patient's back or legs can be adjusted to a desired inclination. The actuating mechanism for the head section of the articulated mattress frame may include an electric motor which rotates an elongated threaded shaft. A nut is threadably mounted for longitudinal movement along the shaft and is fixed against rotation relative thereto. Thus, rotation of the shaft produces longitudinal travel of the nut. A linkage interconnects the nut and the head section of the articulated frame in such a way as to convert longitudinal motion of the hut into rotational movement of the head section, thereby altering the inclination of the latter. The motor can be deactivated at any time to hold the head section in a given position of adjustment.

U.S. Pat. No. 4,559,655 describes the conventional motorized hospital bed in which the head and leg sections of an articulated frame can be selectively raised and lowered by two or more electric motors. In this fashion, a patient's back and/or legs can be adjusted to a desired inclination. The actuating mechanism for the head section of the articulated mattress frame may include and electric motor which rotates an elongated threaded shaft. A nut is threadedly mounted for longitudinal movement along the shaft and is fixed against rotation relative thereto. Thus, rotation of the shaft produces longitudinal travel of the nut. A linkage interconnects the nut and the head section of the articulated frame in such a way as to convert longitudinal motion of the nut into rotational movement of the head section, thereby altering the inclination of the head section. The motor can be deactivated at any time to hold the head section in a given position of adjustment.

It is well known that hospital and home care and convalescent-type beds, having independently moveable articulated head, knee and leg sections are connected to independent drive mechanisms and motors. U.S. Pat. No. 4,970,737 teaches us that the adjustable hospital and nursing home bed, has a three-part support frame for mattresses, the head, middle and foot part of which are pivotably connected to one anther via pivot shafts and are supported in a suspension frame of a bed frame such that they are pivotable in height directly by means of a force provider via a lever linkage.

U.S. Pat. No. 5,317,769 teaches a hospital bed having two mechanical drive mechanisms connected between each end of a bed support frame and a base, each of which has a respective actuator. Selective operation of each of the drive mechanisms with the actuators permits either end of the bed support frame to be raised or lowered to a desired position.

U.S. Pat. No. 4,425,674 teaches a transmission for an adjustable hospital bed for positioning the bed in a plurality of different positions, the different parts of the bed moving independently and/or simultaneously, the transmission transmitting power to the adjustment mechanisms from a single common drive. The drive motor is stationary or fixed, however, increasing the complexity as well as the likelihood for mechanical failure of the resultant required apparatus.

U.S. Pat. No. 4,472,846 further teaches that different hospital bed functions or adjustments may be made by employing a single reversible motor to drive selected ones of a series of adjusting mechanisms. A bedside control unit for a hospital bed is operable from a position within the bed and also from a bedside chair, as found in U.S. Pat. No. 5,542,138.

U.S. Pat. No. 5,195,198 teaches a hospital bed which has a movable section, a selectively actuable drive arrangement for moving the section, a manually actuable control switch, and a control circuit coupled to the switch and drive arrangement. The control circuit includes a microprocessor having an input coupled to the control switch and having an output, and the program executed by the microprocessor selectively actuates the output of the microprocessor based on a function which takes into account the current state of a signal being applied to the microprocessor input.

Thus, as shown by the foregoing brief review of the prior art, each mode of adjustability, i.e., bed section function, is typically powered by a small, separate gear motor. Since these small motors are relatively expensive and have comparatively little actual running time during the effective life of the bed, such designs are expensive and inefficient. Multiple motors also increase the weight of such beds.

Typically, due to lowered reimbursement rates, guidelines and schedules established by the federal government, beds in use for home care and home convalescence, as well as beds used in hospitals, nursing facilities and other commercial facilities have only two motors, one for raising and lowering the head of the bed and one for raising and lowering the foot of the bed. A hand crank is used to raise and lower the overall height of the bed. As a result, it has been estimated that hundreds if not thousands of injuries occur nationwide on a yearly basis. Patients and their caregivers are injured attempting to move the patient from an improperly adjusted bed. Additional work is required of a caregivers to manually adjust the height of the bed prior to attempting to maneuver the patient, or have the patient move himself or herself. A third motor can also be used for adjusting the overall height of the bed, adding to cost, weight and gear complexity.

SUMMARY OF THE INVENTION

Accordingly, an advantage of the invention is to provide a single motor, fully adjustable bed.

Another advantage of the invention is to provide a bed which is less expensive to build.

Another advantage of the invention is to provide a bed which weighs less than the conventional bed with complex gear structures and two or more motors.

It is an advantage of the present invention to provide a drive for adjustable beds comprising a single, drive motor for efficient operation and reduced manufacturing cost: to provide an adjustable bed drive capable of fully powering a multi-function adjustable bed; to provide an adjustable bed drive which is efficient in use, capable of a long operating life, and particularly well adapted for the proposed use.

It is an advantage of the present invention to provide a fully operational hospital bed for home use with fewer moving parts then presently used. A single motor bed has less weight than current beds. They are easier to service. A single motor can be used for all functions to configure the bed by having the motor ride along a track that, with the aid of a computer program, will stop at each correct spot by knowing how many clicks or teeth marks the motor must move to be in proper alignment. When the motor comes to a stop in alignment with one of the drive shafts, it will connect an electric current that will cause a solenoid to pull, thereby causing the spring loaded connector to extend out and connect with the drive shaft of the desired adjustment that the user selects via a remote control unit. The motor is one that is currently found in today's adjustable beds, with the exception of a different tip on the connector, the shape of the tip will connect with the female version of the shape so that when the connector is extended, it will form a strong link between the motor and the drive shaft of the desired bed adjustment that is selected by the user by a push of a button on the remote control unit.

The unique hospital bed of the present invention includes a transmission which couples a common motor drive only to the selected adjusting mechanisms that should be operated, the drive being decoupled from those adjusting mechanisms that should not be operated. Moreover, and of major importance, the coupling arrangement is extremely reliable and efficient in operation, and is low in cost, power consumption and noise. If the electricity is disengaged for any reason all drive shafts are disengaged. This will allow for free hand movement of the motor either to the left or the right. This will allow anyone to insert an emergency crank into any of the drive shafts to move that drive shaft by hand.

These and many other important advantage, feature and objects of the present invention will be further understood and appreciated by those skilled in the art by reference, will become readily apparent from the following detailed description of the invention and the embodiments thereof, from the claims and from the accompanying drawings.

DETAILED DESCRIPTION

Figure 1:
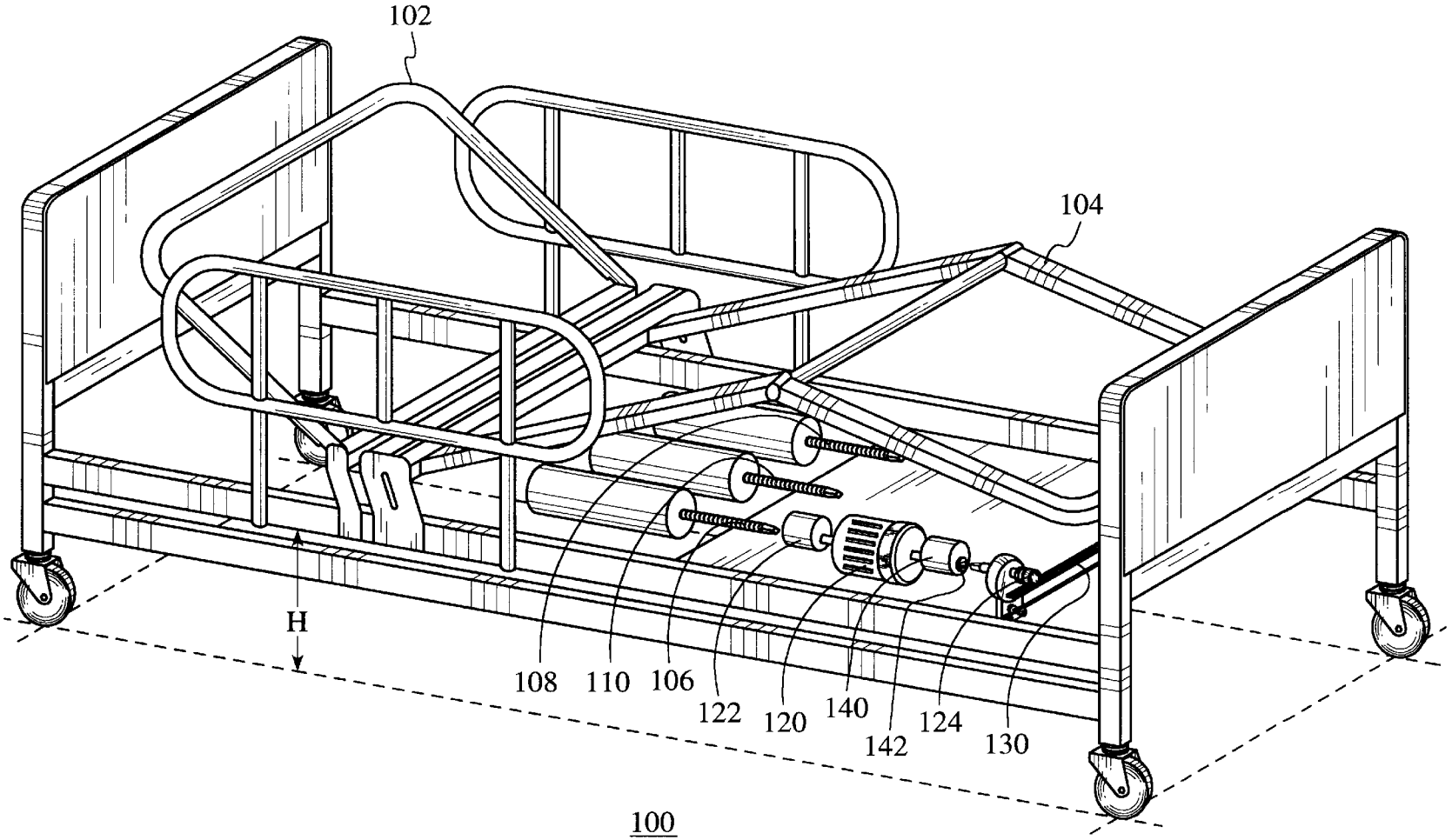
FIG. 1 is an representative isometric view of a preferred embodiment for a motor, fully adjustable bed of the present invention.

It will be understood that while numerous preferred embodiments of the present invention are presented herein, numerous of the individual elements and functional aspects of the embodiments are similar. Therefore, it will be understood that structural elements of the numerous apparatus disclosed herein having similar or identical function will have like reference numerals associated therewith.

FIG. 1A is an representative isometric view of a preferred embodiment for a single motor, fully adjustable bed 100 of the present invention. As shown, the bed 100 has an adjustable head section 102, an adjustable leg section 104, and an adjustable height H. Three separate drive shafts 106, 108 and 110 are acted upon, as desired and according to the specifications disclosed herein, by motor 120.

Motor coupling 122 selectively engages one of drive shafts 106, 108 or 110 to either raise and/or lower the head section 102, raise and/or lower the leg section 104 and to raise and/or lower the overall height H of bed 100. The motor is moved by tracking gear 124 which rides on toothed track 130 which allows the motor 120 to move linearly, thus allowing use of the single motor for each of the modes of adjustment, i.e., head section 102 up and/or down, leg section 104 up and/or down and bed height H up and/or down. Second solenoid-type coupling 140 is used to control movement of the motor along the track.

Figure 2:
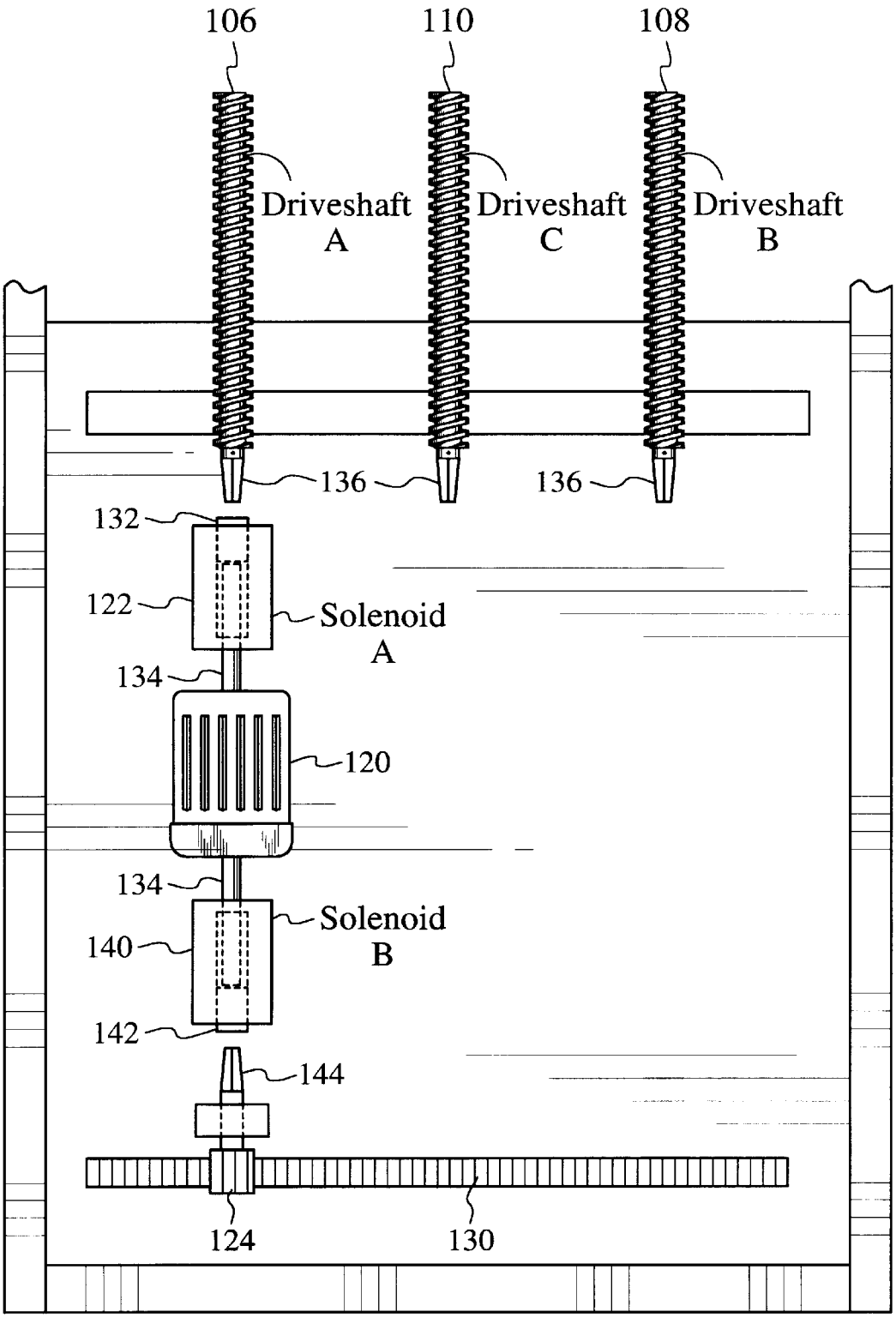
FIG. 2 is a representative schematic of a preferred embodiment of a drive assembly of a single motor, fully adjustable bed of the present invention.

FIG. 2 is a representative schematic view of a preferred embodiment of a drive assembly of a single motor 120, of the fully adjustable bed 100 of the present invention. The drawing shows motor 120 in alignment with one of the drive shafts 106, 108 or 110. Solenoid-type coupling 122 comprises an electrically actuated solenoid-type, rotating contact or other switch which causes the first extendable end 132 of motor shaft 134 to extend and engages the tapered connector 136 of each drive shaft.

Another solenoid-type coupling 140 is used to extend a second extendable end 142 to engage a tapered connector 144 on the tracking gear 124. Thus, once engaged, the single motor 120 will cause the tracking gear to move the motor 120 to a position opposite the desired drive shaft for operation of the desired mode of adjustment.

Figure 3:
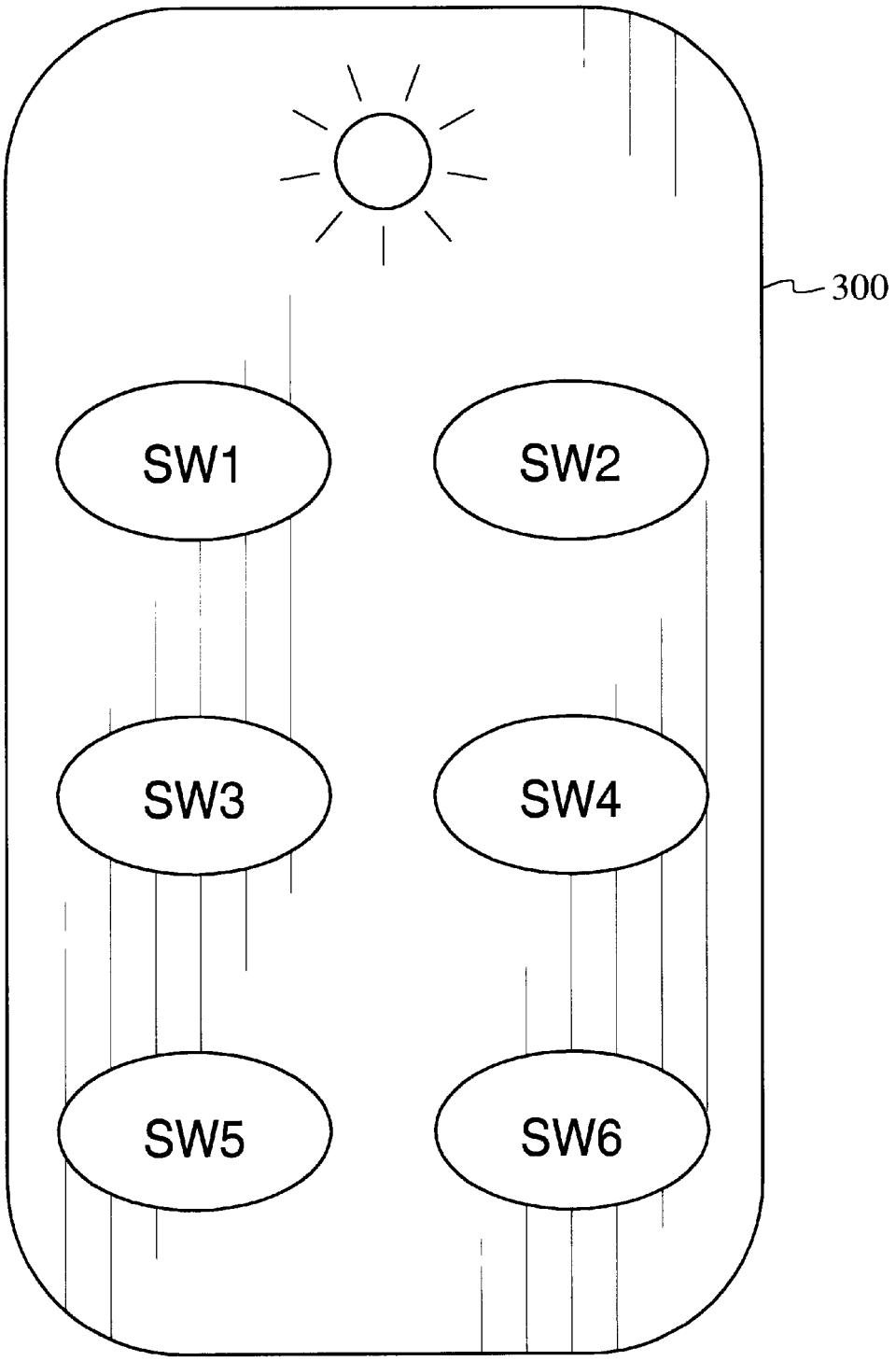
FIG. 3 is a representative view of a preferred embodiment of a manual control handpiece for a single motor, fully adjustable bed of the present invention.

FIG. 3 is a representative view of a preferred embodiment of a manual control handpiece 300 for a single motor, fully adjustable bed of the present invention. The following table identifies the mode of operation which can be selected by a user.

| Control Button | Mode of Adjustment |
|---|---|
| SW1 | Raise head section |
| SW2 | Lower head section |
| SW3 | Raise leg section |

-continued

| Control Button | Mode of Adjustment |
|---|---|
| SW4 | Lower leg section |
| SW5 | Raise overall bed height |
| SW6 | Lower overall bed height |

Figure 4:
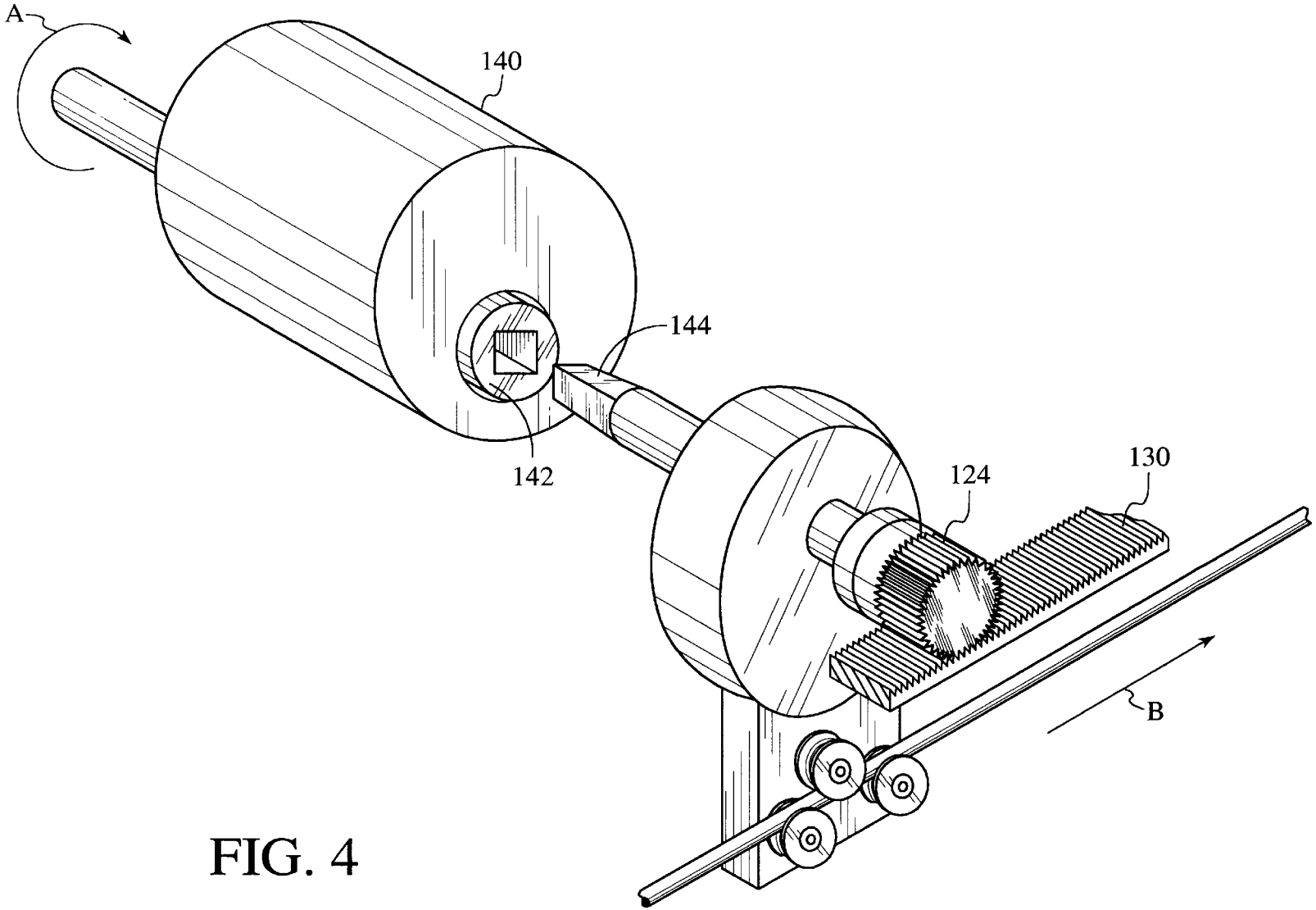
FIG. 4 is a representative isometric view of a preferred embodiment of a motor driven linear tracking system for a single motor, fully adjustable bed of the present invention.

FIG. 4 is a representative isometric view of a preferred embodiment of a motor driven linear tracking system for a single motor, fully adjustable bed of the present invention. The second extendable end 142 of solenoid-type coupling 140 of the motor 120, couples with the tracking gear 124 via the tapered connector 144. The motor, for example rotating in direction shown by arrow A, moves linearly along the toothed track 130, for example in the direction shown by arrow B.

Figure 5:
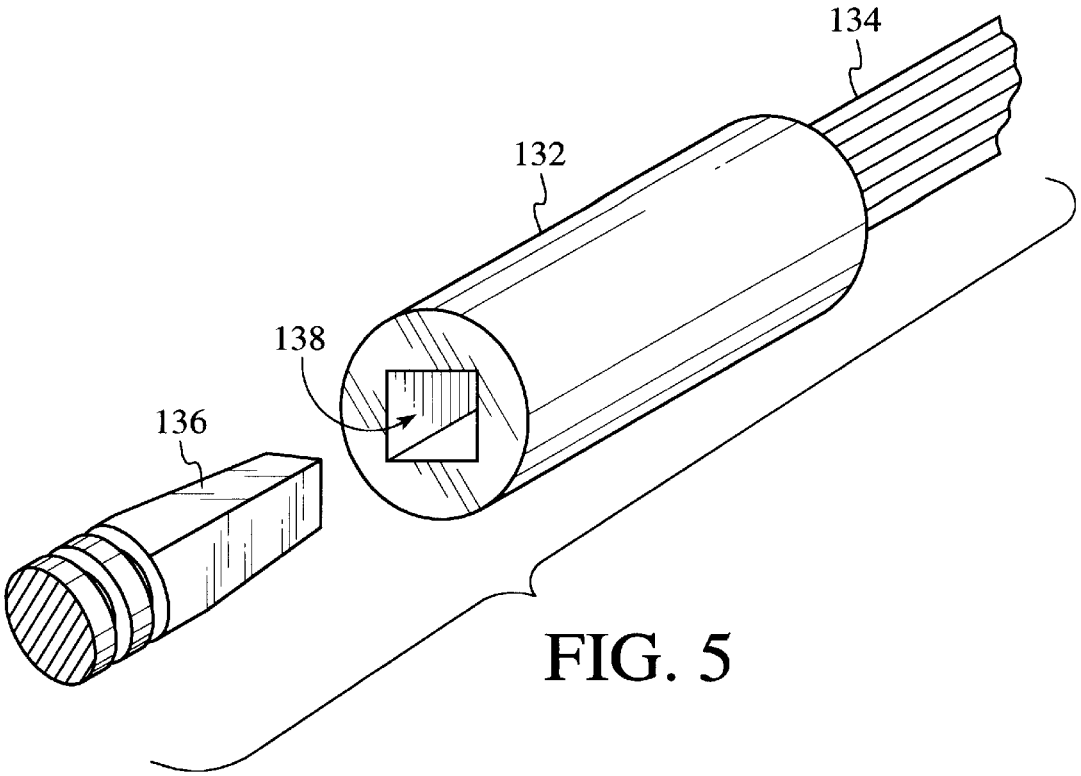
FIG. 5 is a representative detail view of a preferred embodiment of a motor drive coupling for a single motor, fully adjustable bed of the present invention.

FIG. 5 is a representative detail view of a preferred embodiment of a motor drive coupling for a single motor, fully adjustable bed of the present invention. FIG. 5 shows a detailed illustration of the solenoid-type coupling 122 which pushes the extendable end 132 of the motor shaft 134 onto the tapered connector 136 of the desired drive shaft 106,108 or 110. This "unicorn head" design has been used in other applications of a type of keyed, locking clutch mechanism. The tapered portion 136 can be any operative geometry, or have a splined outer surface with a matching grooved or other shaped opening 138 within the extendable end 132.

Figure 6:
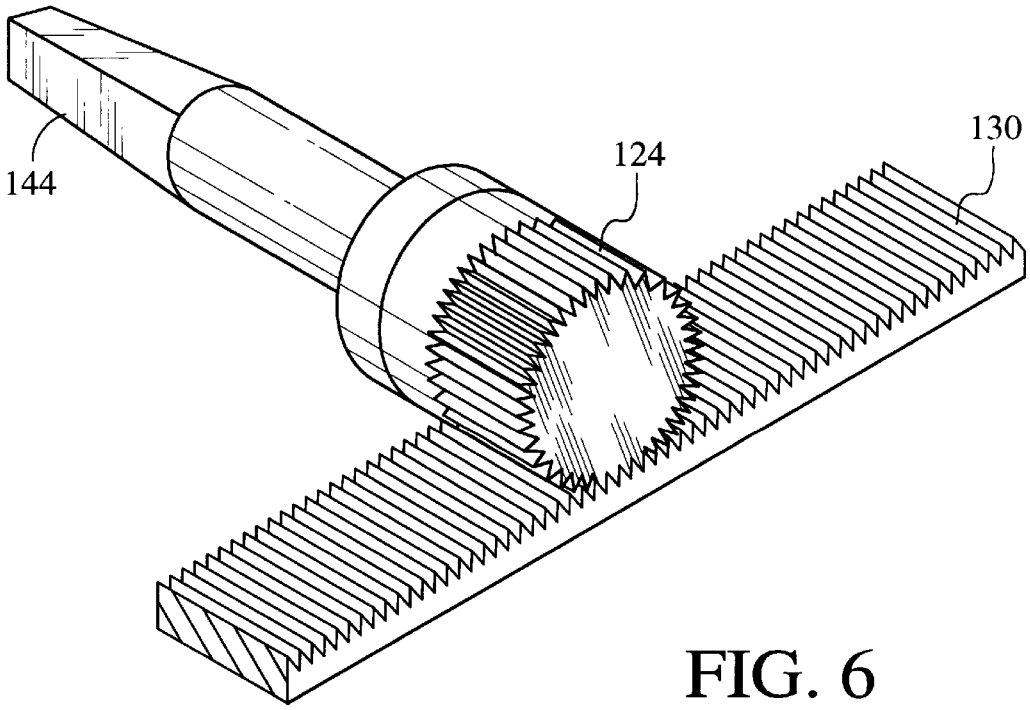
FIG. 6 is a representative detail view of a preferred embodiment of a motor position selection gear assembly for a single motor, fully adjustable bed of the present invention.

FIG. 6 is a representative detail view of a preferred embodiment of a motor position selection gear assembly for a single motor, fully adjustable bed of the present invention. Showing close-up views of the linear tracking function of the single motor 120. The motor shaft 134 gets extended by solenoid driven coupling 140 which pushes a second extendable end 142 onto the tapered connector 144 of the shown tracking gear 124 that is engaged to the linear track 130.

Figure 7:
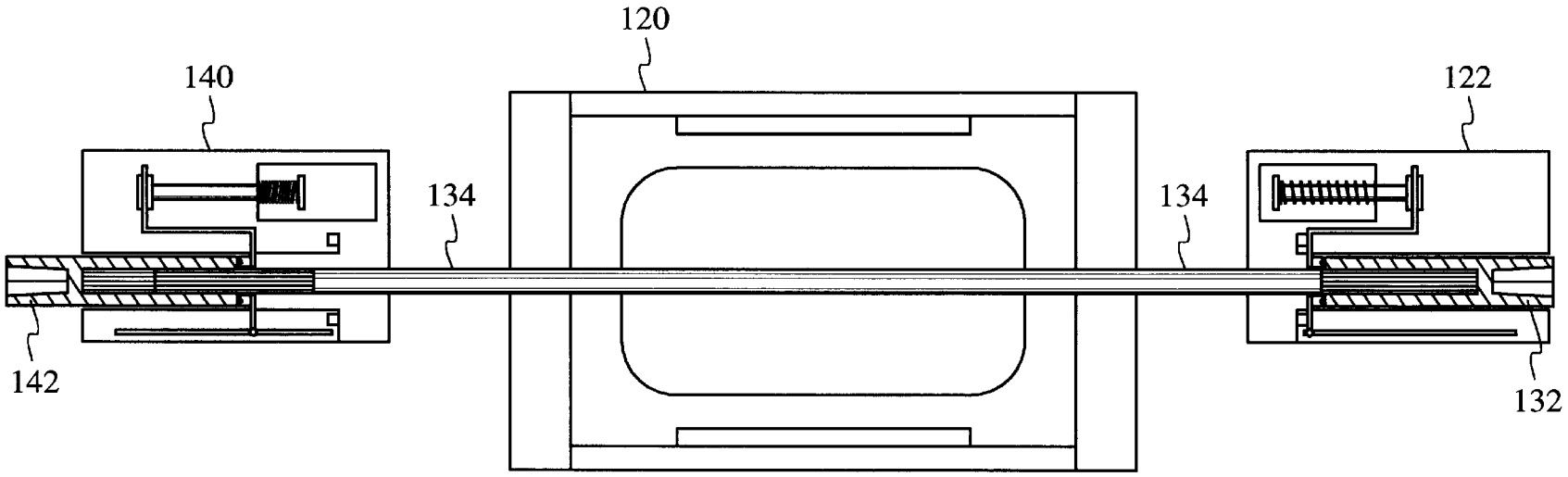
FIG. 7 is a representative schematic view of a preferred embodiment of a motor with solenoid-driven coupling drive shaft for a single motor, fully adjustable bed of the present invention.
Figure 7A:
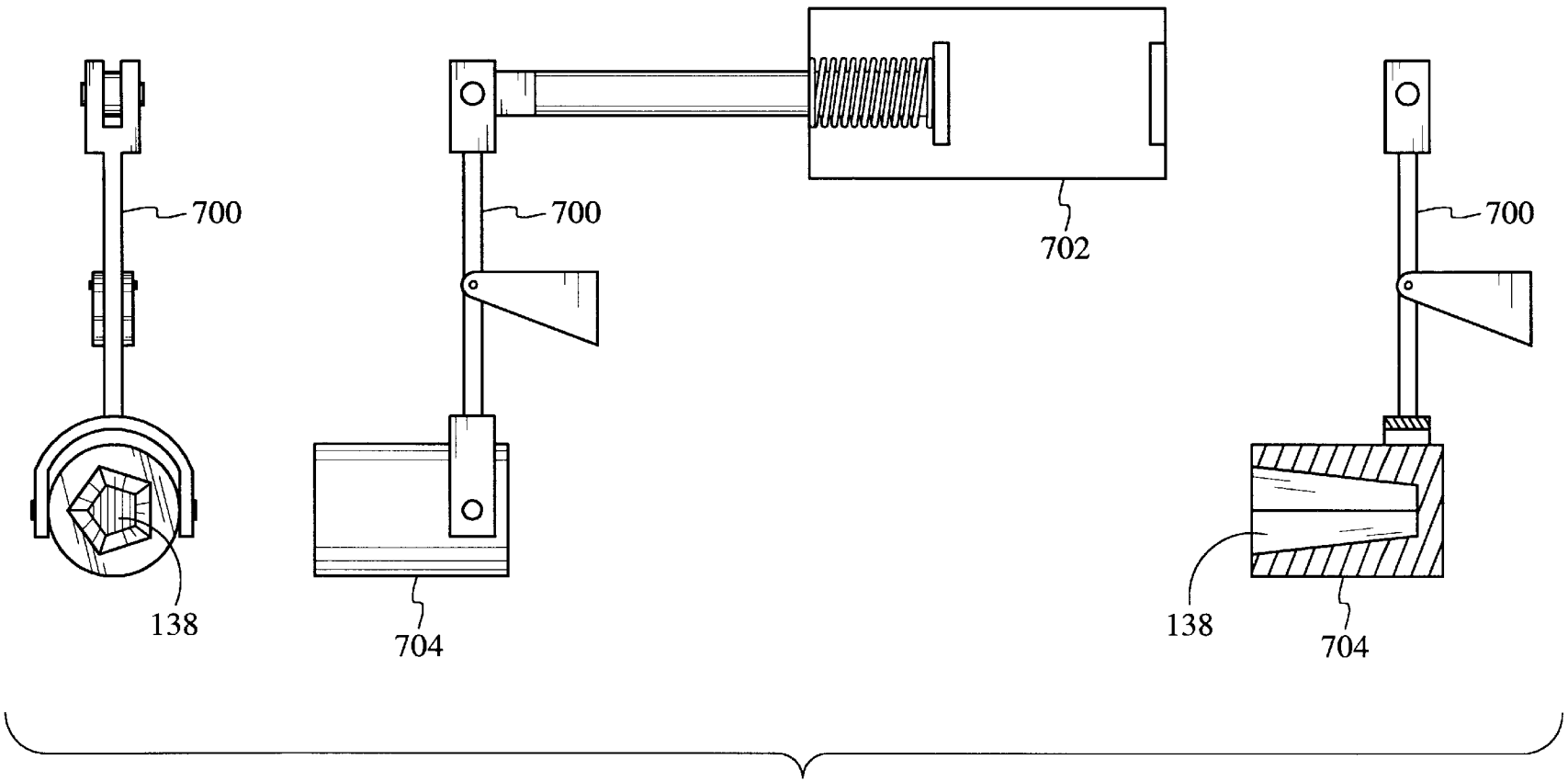
FIG. 7A is a representative schematic view of a preferred embodiment of solenoid-type offset linkage coupling to a drive shaft for a single motor, fully adjustable bed of the present invention.
Figure 8A:
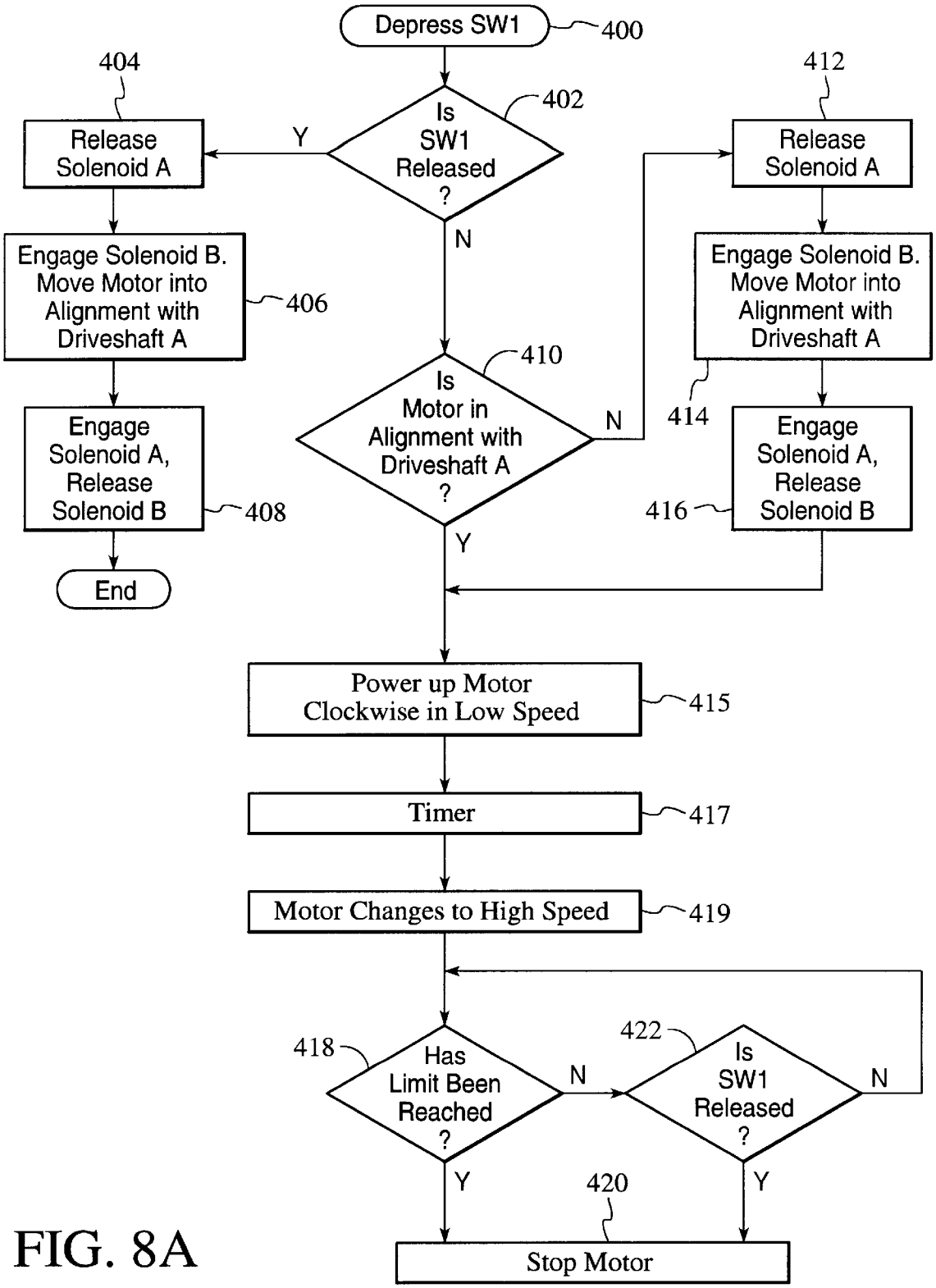
FIGS. 8A–8F are a representative schematic view of a preferred embodiment of a method of operation of a single motor, fully adjustable bed of the present invention.
Figure 8B:
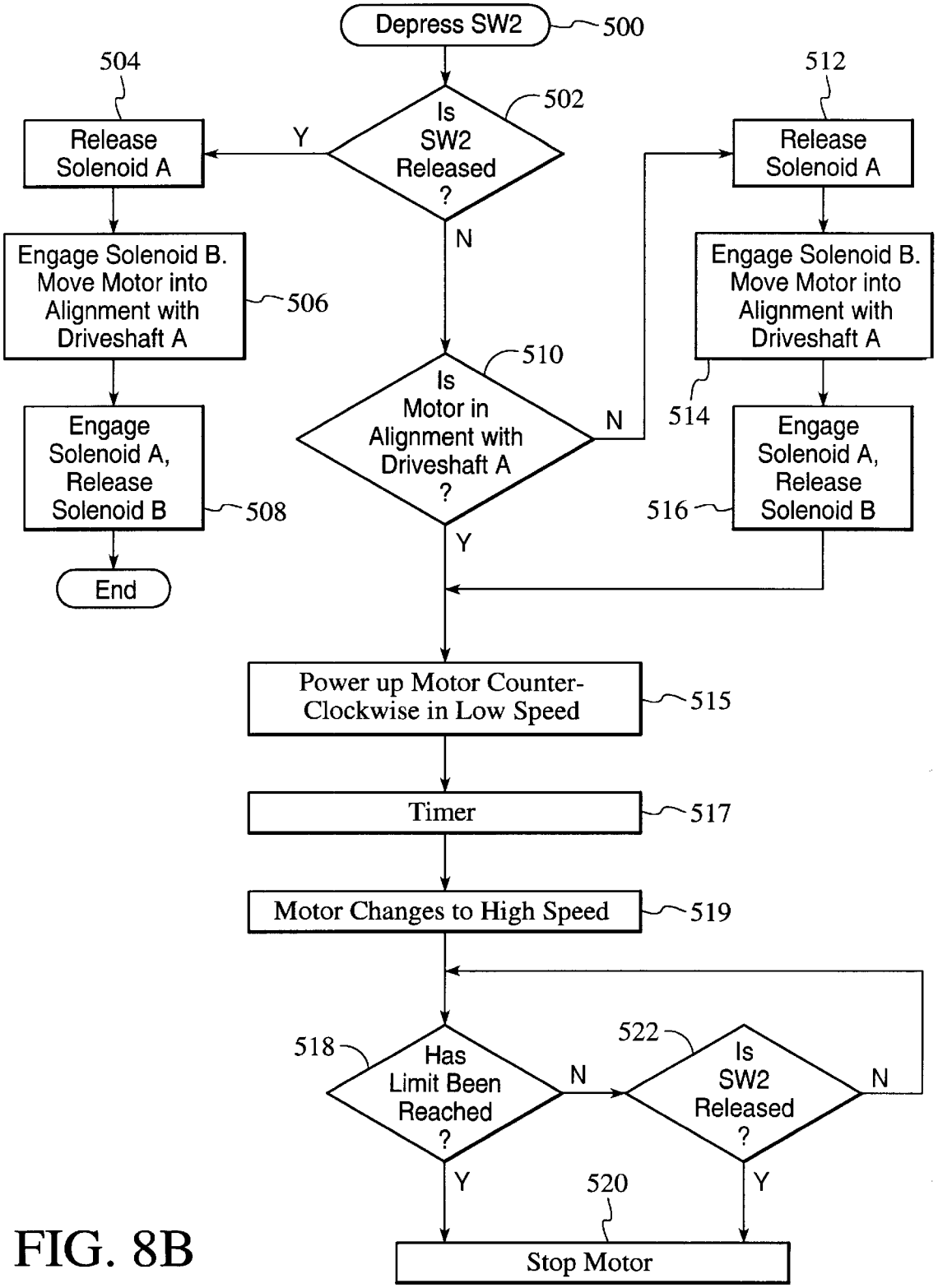
Figure 8C:
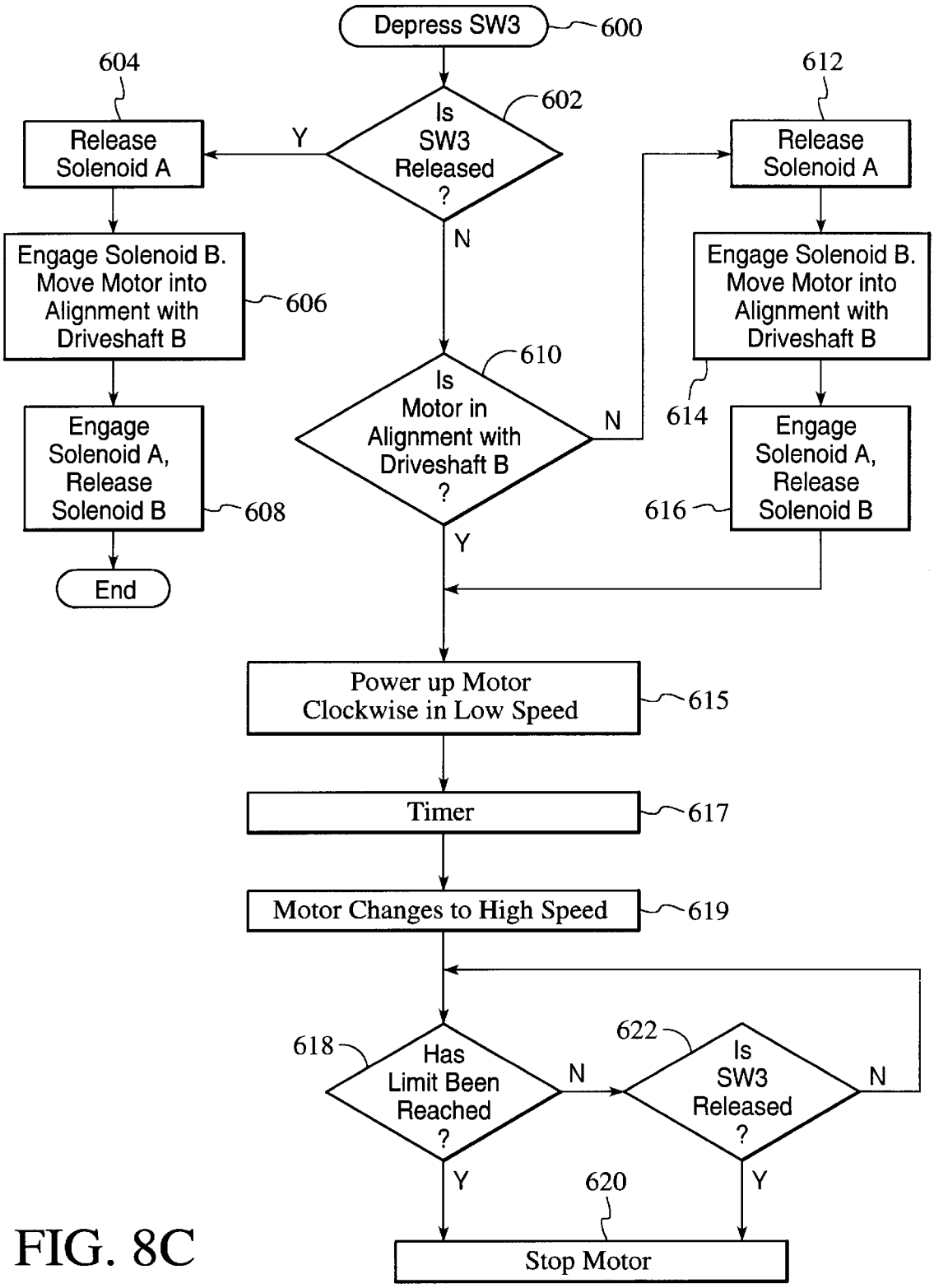
Figure 8D:
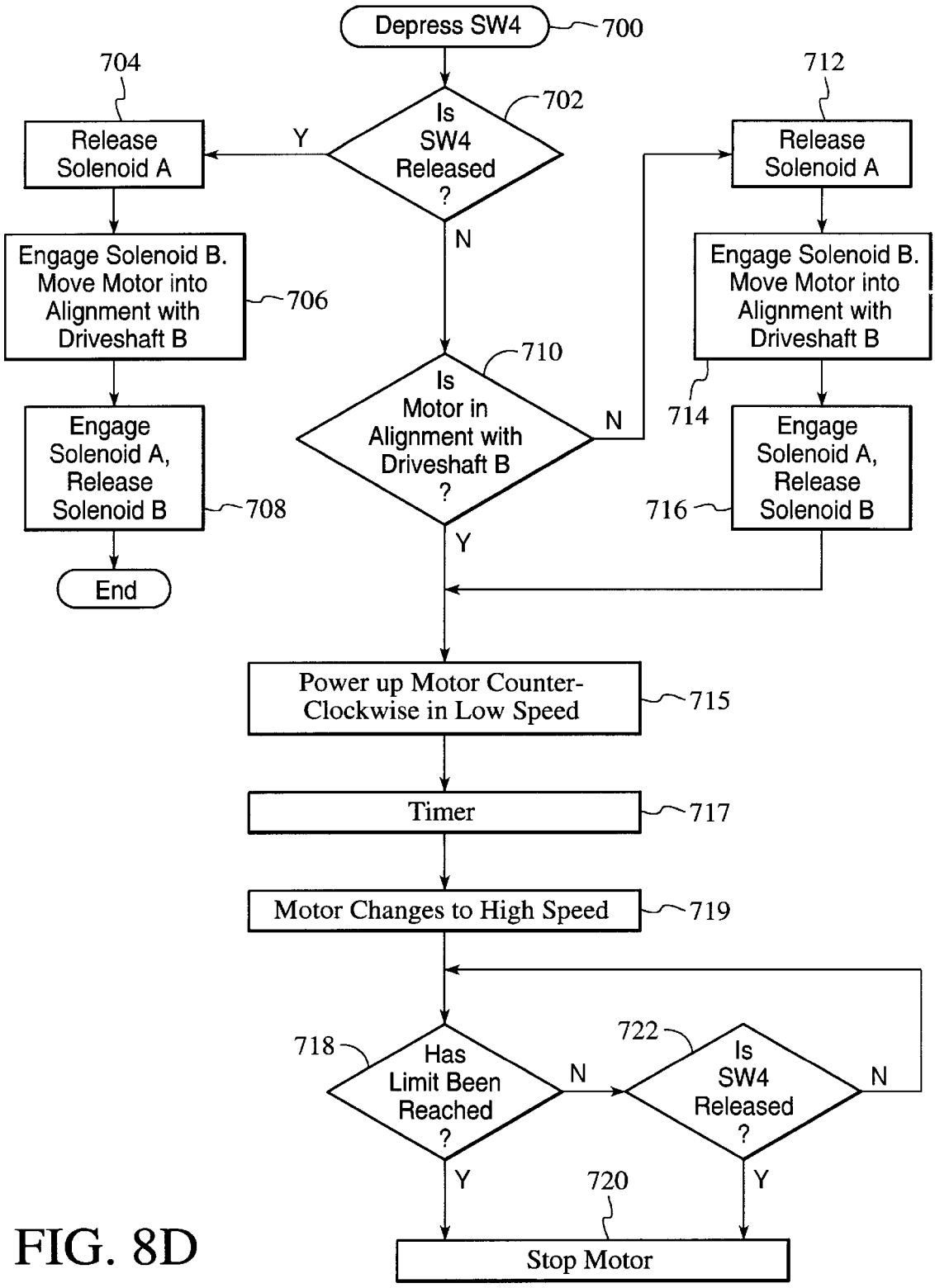
Figure 8E:
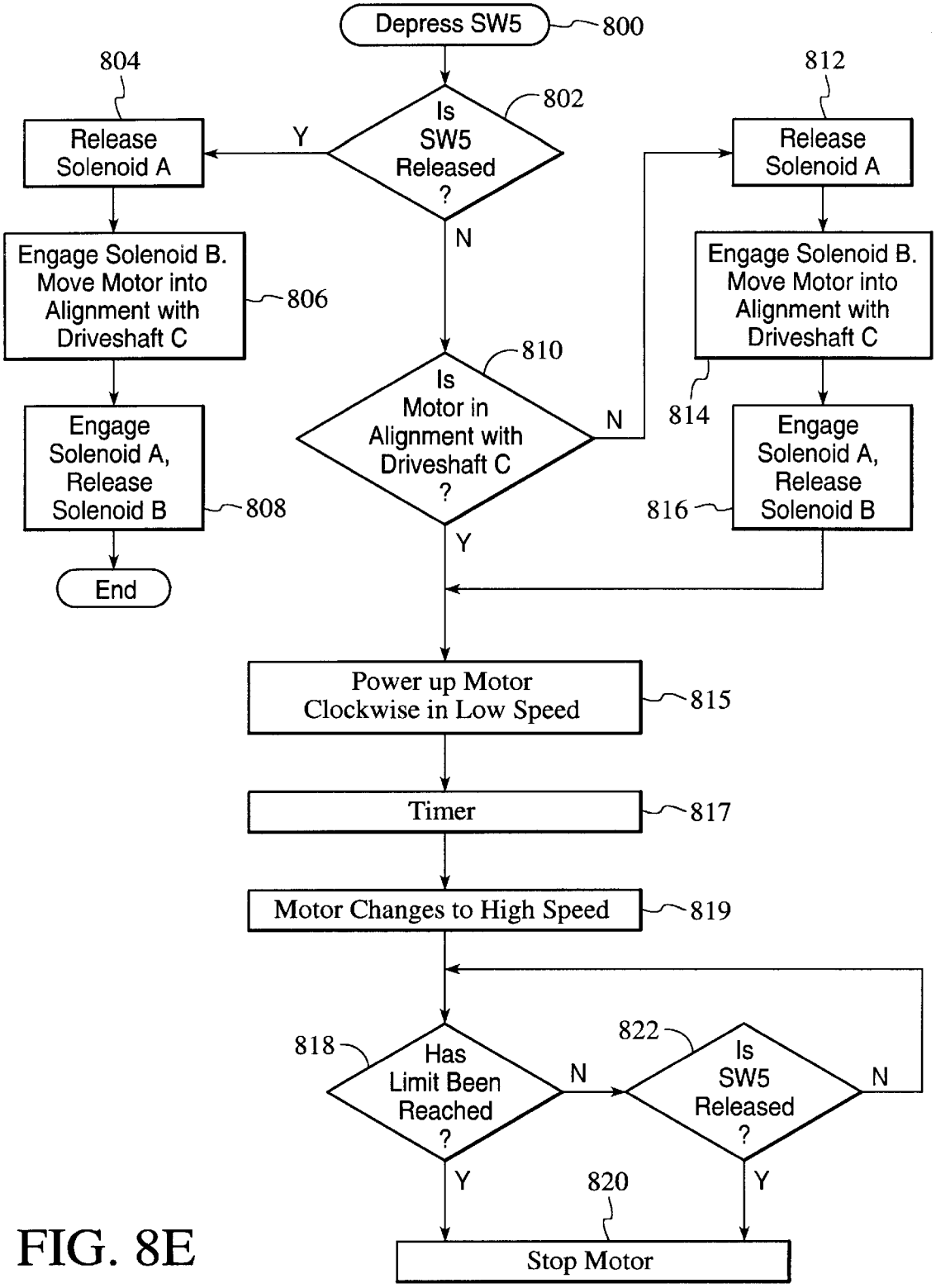
Figure 8F:
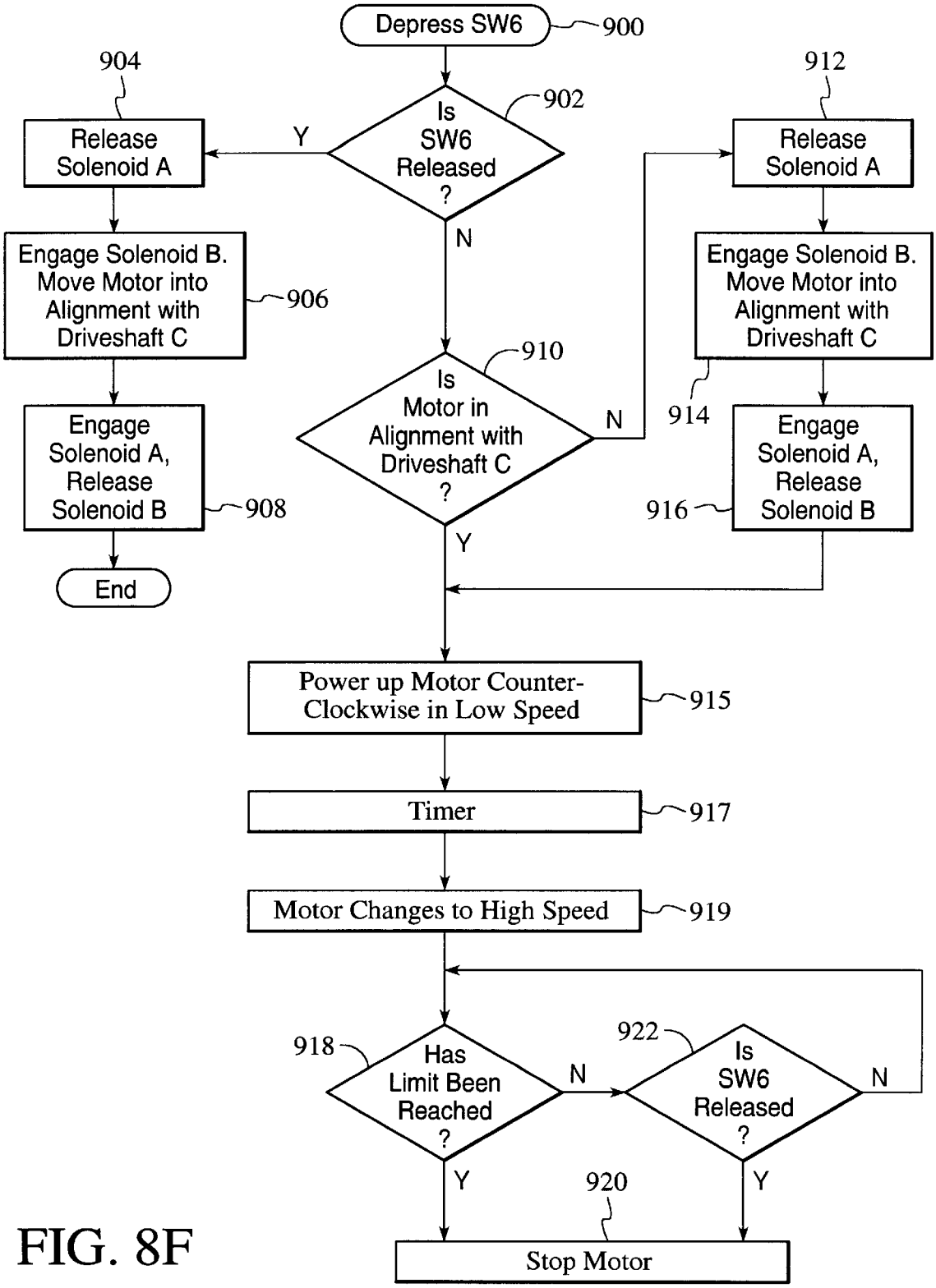

FIG. 7 is a representative schematic view of a preferred embodiment of a motor with solenoid-driven coupling drive shaft for a single motor, fully adjustable bed of the present invention. FIG. 7 shows the motor 120 and the motor shaft 134 with two extendable ends 132 and 142. Each end is extended by solenoid type couplings 122 and 140. As described above, each of the extendable ends 132 and 142 engages a tapered connector 136 and 144, respectively, as shown in FIG. 6. As shown, extendable end 132 is in its retracted state whereas extendable end 142 is extended FIG. 7A is a representative schematic view of a preferred embodiment of solenoid-type offset linkage coupling to a drive shaft for a single motor, fully adjustable bed of the present invention. It will be understood by those skilled in the art that the extendable end may be actuated by a solenoid-type switch such as described herein, but other designs which will be included within the scope of the present invention and incorporated herein include providing an offset linkage 700 which, when actuated by a solenoid-type switch 702, etc., may advance an extendable end 704 linked to the switch. Any offset, remote, external or otherwise actuable linkage may be used and will be considered within the scope of the present invention.

FIGS. 8A–8F are a representative schematic view of a preferred embodiment of a method of operation of a single motor, fully adjustable bed of the present invention. For the following description, coupling means 122 and 140 are solenoid-type switches, hereafter referred to as A and B, respectively, having a normally retracted un-activated position. Additionally, driveshafts 106, 108, and 110, or A, B and C, respectively, operate to raise and lower the head section 102, the leg section 104 and the overall height H.

Head Section Operation

In a first mode of operation, the head section 102 is to be raised. An operator depresses switch SW1 in step 400. In step 402, if switch SW1 is released, then solenoid A is moved into a retracted position in step 404. In step 406, solenoid B extends extendable end 142 to couple with tapered end 144 to move motor 120 into alignment with drive shaft 106. In step 408, solenoid B retracts, disengaging motor 120 from toothed track 130, and solenoid A engages motor 120 and drive shaft A by extending extendable end 122 about tapered end 136.

In step 402, if switch SW1 is not released, then a determination is made as to whether motor 120 is in alignment or not with 106 drive shaft A, as shown in step 410. If motor 120 is not in alignment with 106 drive shaft A, then in step 412 solenoid A is released, in step 414 solenoid B engages tapered end 144 to move motor 120 into alignment with driveshaft A. Then, in step 416, the extendable couplings switch, and solenoid B is released so that extendable end 142 is retracted and solenoid A is activated to extend extendable end 132 over tapered end 136.

If motor 120 is in alignment with 106 drive shaft A, then a sequence of individual steps takes place in which the motor is energized in low speed 415 for a predetermined small time interval 417 after which the motor's speed is increased to an operational speed 419. Thus, it will be understood that the motor engages the tapered ends 136, one at a time of course, and then starts to turn slowly to ensure proper seating between the extendable coupling 122 and the tapered end 136. Thereafter, the operational speed is greater.

In step 418, once the head section has been raised to the maximum height possible, then the motor 120 stops, step 420. If however, the desired height is achieved, and SW1 is released prior to the head section reaching it's maximum height, as shown in step 422, then the motor 120 will also stop.

To lower the head section 102, an operator depresses switch SW2 in step 500. In step 502, if switch SW2 is released, then solenoid A is moved into a retracted position in step 504. In step 506, solenoid B extends extendable end 142 to couple with tapered end 144 to move motor 120 into alignment with drive shaft 106. In step 508, solenoid B retracts, disengaging motor 120 from toothed track 130, and solenoid A engages motor 120 and drive shaft A by extending extendable end 122 about tapered end 136.

In step 502, if switch SW2 is not released, then a determination is made as to whether motor 120 is in alignment or not with 106 drive shaft A, as shown in step 510. If motor 120 is not in alignment with drive shaft A, then in step 512 solenoid A is released, in step 514 solenoid B engages tapered end 144 to move motor 120 into alignment with driveshaft A. Then, in step 516, the extendable couplings switch, and solenoid B is released so that extendable end 142 is retracted and solenoid A is activated to extend extendable end 132 over tapered end 136.

If motor 120 is in alignment with 106 drive shaft A, then a sequence of individual steps takes place in which the motor is energized (in the opposite direction as in step 415) in low speed 515 for a predetermined small time interval 517 after which the motor's speed is increased to an operational speed 519. Thereafter, the operational speed is greater.

In step 518, once the head section has been lowered to it's minimum height, i.e. lowered completely, then the motor 120 stops, step 520. If however, the desired height is achieved, and SW2 is released prior to being lowered completely, as shown in step 522, then the motor 120 will also stop.

Leg Section Operation

In a second mode of operation, the leg section 104 is to be raised. An operator depresses switch SW3 in step 600. In step 602, if switch SW3 is released, then solenoid A is moved into a retracted position in step 604. In step 606, solenoid B extends extendable end 142 to couple with tapered end 144 to move motor 120 into alignment with drive shaft 108. In step 608, solenoid B retracts, disengaging motor 120 from toothed track 130, and solenoid A engages motor 120 and drive shaft A by extending extendable end 122 about tapered end 136.

In step 602, if switch SW3 is not released, then a determination is made as to whether motor 120 is in alignment or not with 108 drive shaft B, as shown in step 610. If motor 120 is not in alignment with drive shaft B, then in step 612 solenoid A is released, in step 614 solenoid B engages tapered end 144 to move motor 120 into alignment with driveshaft B. Then, in step 616, the extendable couplings switch, and solenoid B is released so that extendable end 142 is retracted and solenoid A is activated to extend extendable end 132 over tapered end 136.

If motor 120 is in alignment with 108 drive shaft B, then a sequence of individual steps takes place in which the motor is energized in low speed 615 for a predetermined small time interval 617 after which the motor's speed is increased to an operational speed 619. Thus, it will be understood that the motor engages the tapered ends 136, one at a time of course, and then starts to turn slowly to ensure proper seating between the extendable coupling 122 and the tapered end 136. Thereafter, the operational speed is greater.

In step 618, once the leg section has been raised to the maximum height possible, then the motor 120 stops, step 620. If however, the desired height is achieved, and SW3 is released prior to the leg section 104 reaching it's maximum height, as shown in step 622, then the motor 120 will also stop.

To lower the leg section 104, an operator depresses switch SW4 in step 700. In step 702, if switch SW4 is released, then solenoid A is moved into a retracted position in step 704. In step 706, solenoid B extends extendable end 142 to couple with tapered end 144 to move motor 120 into alignment with drive shaft 108. In step 708, solenoid B retracts, disengaging motor 120 from toothed track 130, and solenoid A engages motor 120 and drive shaft B by extending extendable end 122 about tapered end 136.

In step 702, if switch SW4 is not released, then a determination is made as to whether motor 120 is in alignment or not with 108 drive shaft B, as shown in step 710. If motor 120 is not in alignment with drive shaft B, then in step 712 solenoid A is released, in step 714 solenoid B engages tapered end 144 to move motor 120 into alignment with driveshaft B. Then, in step 716, the extendable couplings switch, and solenoid B is released so that extendable end 142 is retracted and solenoid A is activated to extend extendable end 132 over tapered end 136.

If motor 120 is in alignment with 108 drive shaft B, then a sequence of individual steps takes place in which the motor is energized (in the opposite direction as in step 615) in low speed 715 for a predetermined small time interval 717 after which the motor's speed is increased to an operational speed 719. Thereafter, the operational speed is greater.

In step 718, once the leg section 104 has been lowered completely, then the motor 120 stops, step 720. If however, the desired height is achieved, and SW4 is released prior to being lowered completely, as shown in step 722, then the motor 120 will also stop.

Height Adjustment

In its third mode of operation, the overall height H of the bed is to be raised. An operator depresses switch SW5 in step 800. In step 802, if switch SW5 is released, then solenoid A is moved into a retracted position in step 804. In step 806, solenoid B extends extendable end 142 to couple with tapered end 144 to move motor 120 into alignment with drive shaft 110. In step 808, solenoid B retracts, disengaging motor 120 from toothed track 130, and solenoid A engages motor 120 and drive shaft A by extending extendable end 122 about tapered end 136.

In step 802, if switch SW5 is not released, then a determination is made as to whether motor 120 is in alignment or not with 110 drive shaft C, as shown in step 810. If motor 120 is not in alignment with drive shaft C, then in step 812 solenoid A is released, in step 814 solenoid B engages tapered end 144 to move motor 120 into alignment with driveshaft C. Then, in step 816, the extendable couplings switch, and solenoid B is released so that extendable end 142 is retracted and solenoid A is activated to extend extendable end 132 over tapered end 136.

If motor 120 is in alignment with 110 drive shaft C, then a sequence of individual steps takes place in which the motor is energized in low speed 815 for a predetermined small time interval 817 after which the motor's speed is increased to an operational speed 819. Thus, it will be understood that the motor engages the tapered ends 136, one at a time of course, and then starts to turn slowly to ensure proper seating between the extendable coupling 122 and the tapered end 136. Thereafter, the operational speed is greater.

In step 818, once the height of the bed H has been raised to its maximum height possible, then the motor 120 stops, step 820. If however, the desired height is achieved, and SW5 is released prior to the bed reaching it's maximum height, as shown in step 822, then the motor 120 will also stop.

To lower the lower the overall height H, an operator depresses switch SW6 in step 900. In step 902, if switch SW6 is released, then solenoid A is moved into a retracted position in step 904. In step 906, solenoid B extends extendable end 142 to couple with tapered end 144 to move motor 120 into alignment with drive shaft 110. In step 908, solenoid B retracts, disengaging motor 120 from toothed track 130, and solenoid A engages motor 120 and drive shaft C by extending extendable end 122 about tapered end 136.

In step 902, if switch SW6 is not released, then a determination is made as to whether motor 120 is in alignment or not with 110 drive shaft C, as shown in step 910. If motor 120 is not in alignment with drive shaft C, then in step 912 solenoid A is released, in step 914 solenoid B engages tapered end 144 to move motor 120 into alignment with driveshaft B. Then, in step 716, the extendable couplings switch, and solenoid B is released so that extendable end 142 is retracted and solenoid A is activated to extend extendable end 132 over tapered end 136.

If motor 120 is in alignment with 110 drive shaft C, then a sequence of individual steps takes place in which the motor is energized (in the opposite direction as in step 815) in low speed 915 for a predetermined small time interval 917 after which the motor's speed is increased to an operational speed 919. Thereafter, the operational speed is greater.

In step 918, once the bed has been lowered completely, then the motor 120 stops, step 920. If however, the desired height is achieved, and SW6 is released prior to being lowered completely, as shown in step 922, then the motor 120 will also stop.

It will be understood that the foregoing description of the control scheme, FIGS. 8A–8F, utilized with the single motor, fully adjustable bed of the present invention is but one embodiment of any of numerous control schemes possible. Those skilled in the art will understand that with the availability of pre-programmed, programmable and semi-programmable integrated circuits and other micro devices, additional, auxiliary, enhanced and complementary modes of control may be implemented.

Additionally, as will be understood by those skilled in the art, that the double extendable ends with dual solenoid design may be implemented utilizing a sub-motor, such as a very small, electric powered motor, to track the main motor 120 back and forth along toothed track 130. This sub-motor will position the main motor 120 adjacent the appropriate driveshaft, 106, 108 or 110. Other means for moving the main motor 120 linearly along track 130 will be known, and will include sub-motors, pulley assemblies such as found in printers and print head drive assemblies, for tracking the main motor linearly, as desired and for enhanced control of the bed of the present invention.

Unless defined otherwise, all technical and scientific terms used herein have the same meaning as commonly understood by one of ordinary skill in the art to which this invention belongs. Although any methods and materials similar or equivalent to those described can be used in the practice or testing of the present invention, the preferred methods and materials are now described.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, with the limits only of the true purview, spirit and scope of the invention.

I claim:

1. A fully adjustable bed having an adjustable head section, and adjustable leg section and adjustable overall height, the bed comprising:

a linearly movable motor;

at least three separate drive shafts, a first drive shaft for controlling the adjustable head section, a second drive shaft for controlling the adjustable leg section, and a third drive shaft for controlling the height of the platform of the bed;

means for positioning the motor adjacent a selected drive shaft; and means for selectively coupling the motor with the selected drive shaft, whereby the motor accomplishes desired adjustment of head section, leg section and overall height.

2. The bed of claim 1 wherein the means for positioning the motor adjacent a selected drive shaft comprises a linear track extending between the drive shafts and a gear portion coupled to the linear track and engageable with the motor, whereby upon engagement of the gear portion and the motor, the motor can be positioned along the track adjacent the selected drive shaft as desired.

3. The bed of claim 1 wherein the means for positioning the motor adjacent a selected drive shaft comprises a sub-drive assembly.

4. The bed of claim 1 further comprising a controller which prevents simultaneous linear motion of the motor while coupled to any one of the drive shafts adjusting the head section, leg section or overall height of the bed.

5. The bed of claim 4 in which the controller comprises a synchronized, opposing action pair of solenoid switches.

6. The bed of claim 1 in which the at least three drive-shafts have distinctively shaped ends and the means for selectively coupling the motor with the selected drive shaft includes correspondingly distinctively shaped connecting portion, thereby securely coupling the motor and the selected driveshaft.

7. The bed of claim 1 in which the at least three drive-shafts have tapered ends, thereby securely coupling the motor and the selected driveshaft.

* * * * *